US011504964B2

(12) United States Patent
Inoue et al.

(10) Patent No.: US 11,504,964 B2
(45) Date of Patent: Nov. 22, 2022

(54) PRINTING APPARATUS AND PRINTING METHOD

(71) Applicant: Brother Kogyo Kabushiki Kaisha, Nagoya (JP)

(72) Inventors: Haru Inoue, Nagoya (JP); Hiroto Sugahara, Ama (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/367,830

(22) Filed: Jul. 6, 2021

(65) Prior Publication Data

US 2022/0001664 A1 Jan. 6, 2022

(30) Foreign Application Priority Data

Jul. 6, 2020 (JP) ..... JP2020-116400

(51) Int. Cl.
*B41J 2/045* (2006.01)

(52) U.S. Cl.
CPC ..... *B41J 2/04548* (2013.01); *B41J 2/0457* (2013.01)

(58) Field of Classification Search
CPC .. B41J 2/04548; B41J 2/0457; B41J 2202/21; B41J 2/04508; B41J 2/04506; B41J 2/04541; B41J 2/0455; B41J 2/04581; B41J 2/1433; B41J 2/162; B41J 2002/14475
See application file for complete search history.

(56) References Cited

U.S. PATENT DOCUMENTS

| | | | |
|---|---|---|---|
| 7,722,145 | B2 | 5/2010 | Kubota |
| 2008/0158276 | A1 | 7/2008 | Kubota |
| 2017/0282545 | A1 | 10/2017 | Muto |
| 2017/0282547 | A1 | 10/2017 | Hatta |

FOREIGN PATENT DOCUMENTS

| | | | |
|---|---|---|---|
| EP | 3789202 | A1 | 3/2021 |
| JP | 2008-162261 | A | 7/2008 |
| JP | 2012-187859 | A | 10/2012 |

OTHER PUBLICATIONS

Nov. 23, 2021—(EP) Extended Search Report—App 21182295.2.

*Primary Examiner* — Kristal Feggins
(74) *Attorney, Agent, or Firm* — Banner & Witcoff, Ltd.

(57) ABSTRACT

A printing apparatus includes: power supply circuits including at least a first power supply circuit and a second power supply circuit, the power supply circuits having mutually different output voltages; and a head including nozzles, the nozzles forming groups arranged in a first direction, each of the nozzles being associated with any one of the power supply circuits. The groups include a first group and a second group adjacent to each other in the first direction. The first group is formed by nozzles associated with the first power supply circuit and nozzles associated with the second power supply circuit. The second group is formed by nozzles associated with the first power supply circuit and nozzles associated with the second power supply circuit.

20 Claims, 12 Drawing Sheets

Fig. 8

T

| NOZZLE ID | COLUMN ID | ROW ID | GROUP ID | POWER SUPPLY CIRCUIT ID |
|---|---|---|---|---|
| n001 | c01 | r1 | g10 | v01 |
| n002 | c01 | r2 | g10 | v01 |
| n003 | c01 | r3 | g10 | v01 |
| n004 | c01 | r4 | g10 | v01 |
| n005 | c02 | r1 | g10 | v01 |
| ⋮ | ⋮ | ⋮ | ⋮ | ⋮ |
| n008 | c02 | r4 | g10 | v01 |
| n009 | c03 | r1 | g10 | v01 |
| ⋮ | ⋮ | ⋮ | ⋮ | ⋮ |
| n012 | c03 | r4 | g10 | v01 |
| n013 | c04 | r1 | g10 | v01 |
| ⋮ | ⋮ | ⋮ | ⋮ | ⋮ |
| n016 | c04 | r4 | g10 | v01 |
| n017 | c05 | r1 | g20 | v01 |
| ⋮ | ⋮ | ⋮ | ⋮ | ⋮ |
| n032 | c08 | r4 | g20 | v01 |
| n033 | c09 | r1 | g30 | v02 |
| ⋮ | ⋮ | ⋮ | ⋮ | ⋮ |
| n048 | c12 | r4 | g30 | v02 |
| n049 | c13 | r1 | g40 | v03 |
| ⋮ | ⋮ | ⋮ | ⋮ | ⋮ |
| n064 | c16 | r4 | g40 | v03 |
| n065 | c17 | r1 | g50 | v02 |
| ⋮ | ⋮ | ⋮ | ⋮ | ⋮ |
| n080 | c20 | r4 | g50 | v02 |
| n081 | c21 | r1 | g60 | v01 |
| ⋮ | ⋮ | ⋮ | ⋮ | ⋮ |
| n096 | c24 | r4 | g60 | v01 |
| n097 | c25 | r1 | g70 | v01 |
| ⋮ | ⋮ | ⋮ | ⋮ | ⋮ |
| n112 | c28 | r4 | g70 | v01 |

PRINTING APPARATUS AND PRINTING METHOD

CROSS REFERENCE TO RELATED APPLICATION

The present application claims priority from Japanese Patent Application No. 2020-116400 filed on Jul. 6, 2020, the disclosure of which is incorporated herein by reference in its entirety.

BACKGROUND

Field of the Invention

The present disclosure relates to a printing apparatus configured to discharge ink from nozzles and a printing method.

Description of the Related Art

There is known an ink-jet head driving apparatus including: actuators provided corresponding to respective nozzles and configured to discharge ink from the nozzles by amounts corresponding to respective driving signals; a storage configured to store correction data by which ink discharge amounts from the respective nozzles are leveled; a selecting section configured to select one of the driving signals based on the correction data; and a driving section configured to output the selected driving signal to one of the actuators (see Japanese Patent Application Laid-open No. 2008-162261). In this ink-jet head driving apparatus, the nozzles of the ink-jet head are classified into groups depending on characteristics of ink discharge amount from the nozzles. Driving voltage is corrected for each of the groups.

SUMMARY

However, a density difference between dots formed by the nozzles that belong to the same group is not considered in the above ink-jet head driving apparatus.

An object of the present disclosure is that, in a printing apparatus including an ink-jet head in which nozzles are classified into groups depending on discharge characteristics, a density difference between dots formed by nozzles belonging to the same group is reduced and a density difference between two groups adjacent to each other is reduced.

According to a first aspect of the present disclosure, there is provided a printing apparatus, including:

a plurality of power supply circuits including at least a first power supply circuit and a second power supply circuit, the power supply circuits having mutually different output voltages;

a head including a plurality of nozzles, the nozzles forming a plurality of groups arranged in a first direction, each of the nozzles being associated with any one of the power supply circuits;

wherein the groups include a first group and a second group adjacent to each other in the first direction, the first group is formed by a plurality of nozzles associated with the first power supply circuit and a plurality of nozzles associated with the second power supply circuit, and the second group is formed by a plurality of nozzles associated with the first power supply circuit and a plurality of nozzles associated with the second power supply circuit.

According to a second aspect of the present disclosure, there is provided a printing method using a printing apparatus that includes: a plurality of power supply circuits including at least a first power supply circuit and a second power supply circuit, the power supply circuits having mutually different output voltages; a head including a plurality of nozzles, the nozzles forming a plurality of groups arranged in a first direction, each of the nozzles being associated with any one of the power supply circuits, the method including:

discharging a liquid on a print medium from the nozzles of the head; and moving the print medium relative to the nozzles, wherein the groups include a first group and a second group adjacent to each other in the first direction, the first group is formed by a plurality of nozzles associated with the first power supply circuit and a plurality of nozzles associated with the second power supply circuit, and the second group is formed by a plurality of nozzles associated with the first power supply circuit and a plurality of nozzles associated with the second power supply circuit.

According to the first and second aspects of the present disclosure, it is possible to reduce the density difference between the dots formed by the nozzles that belong to the same group and to reduce the density difference between the two groups adjacent to each other, without adjusting the output voltages of the power supply circuits.

BRIEF DESCRIPTION OF THE DRAWINGS

FIG. 8 depicts an example of information stored in a non-volatile memory of the head according to this embodiment.

DESCRIPTION OF THE EMBODIMENTS

Referring to FIGS. 1 to 9, explanation is made about a printing apparatus according to an embodiment of the present disclosure.

Figure 1:
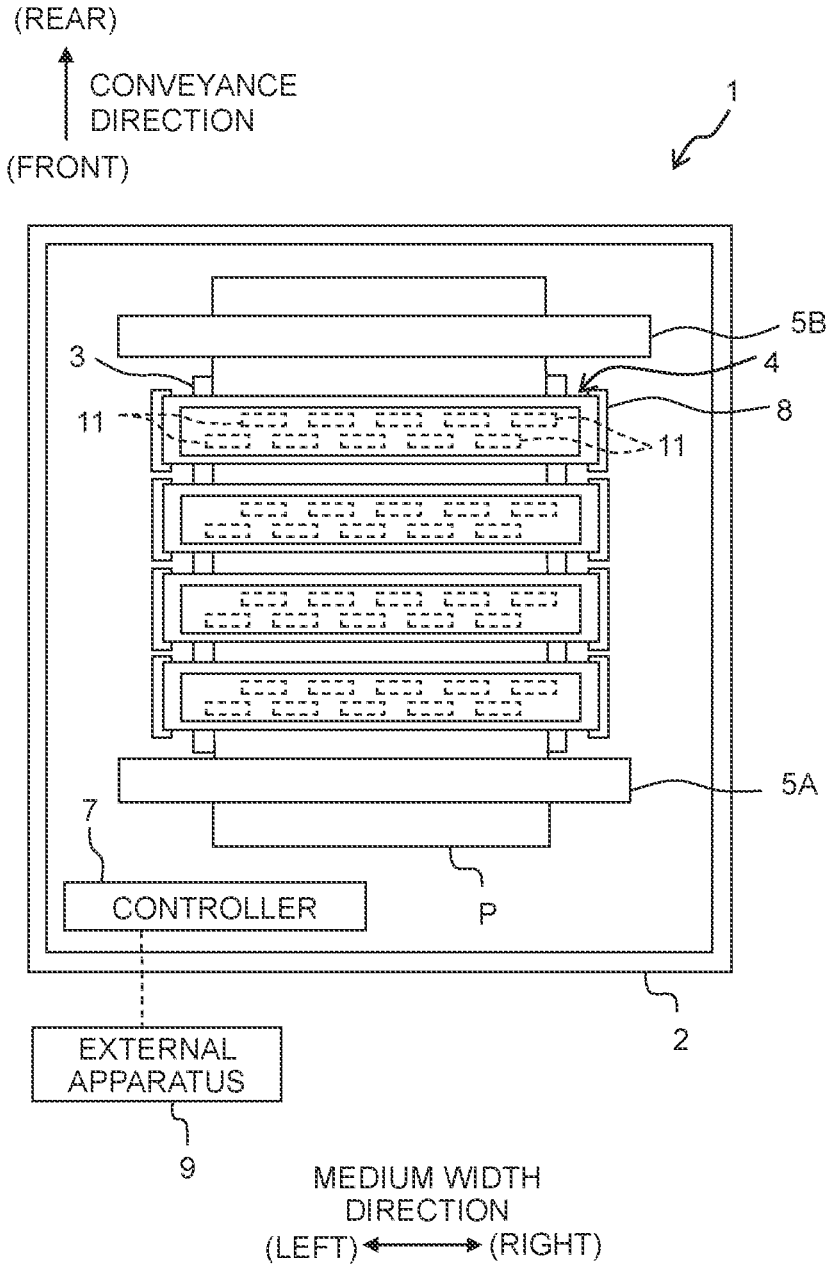
FIG. 1 is a plan view of an exemplary main configuration of a printing apparatus according to this embodiment.

In FIG. 1, an upstream side in a conveyance direction of a print medium P is defined as a front side of a printing apparatus 1, and a downstream side in the conveyance direction of the print medium P is defined as a rear side of the printing apparatus 1. Further, a direction parallel to a surface on which the print medium P is conveyed (a surface parallel to the sheet surface of FIG. 1) and orthogonal to the conveyance direction is defined as a medium width direction. A left side in FIG. 1 is a left side of the printing apparatus 1, and a right side in FIG. 1 is a right side of the printing apparatus 1. A direction orthogonal to the conveyance surface of the print medium P (a direction orthogonal to the sheet surface of FIG. 1) is defined as an up-down direction of the printing apparatus 1. A fore side (front side) of the sheet surface of FIG. 1 is defined as up (upper side), and a far side (the other side) of the sheet surface of FIG. 1 is defined as down (lower side). In the following, explanation is made by appropriately using the front, rear, left, right, up (upper), and down (lower). The medium width direction is an exemplary "first direction" of the present disclosure, and the conveyance direction is an exemplary "second direction" of the present disclosure.

As defined in FIG. 1, the printing apparatus 1 includes a casing 2, a platen 3, four line heads 4, two conveyance rollers 5A, 5B, and a controller 7.

The platen 3 is placed flatly in the casing 2. The print medium P is placed on an upper surface of the platen 3. The four line heads 4 are provided above the platen 3 such that they are arranged in a front-rear direction. The conveyance roller 5A is disposed on the front side of the platen 3 and the conveyance roller 5B is disposed on the rear side of the platen 3. The two conveyance rollers 5A and 5B are driven by a motor (not depicted) to convey the print medium P on the platen 3 rearward. Although the printing apparatus 1 includes the four line heads 4 in this embodiment, the number of the line heads 4 is not limited to four.

Figure 3:
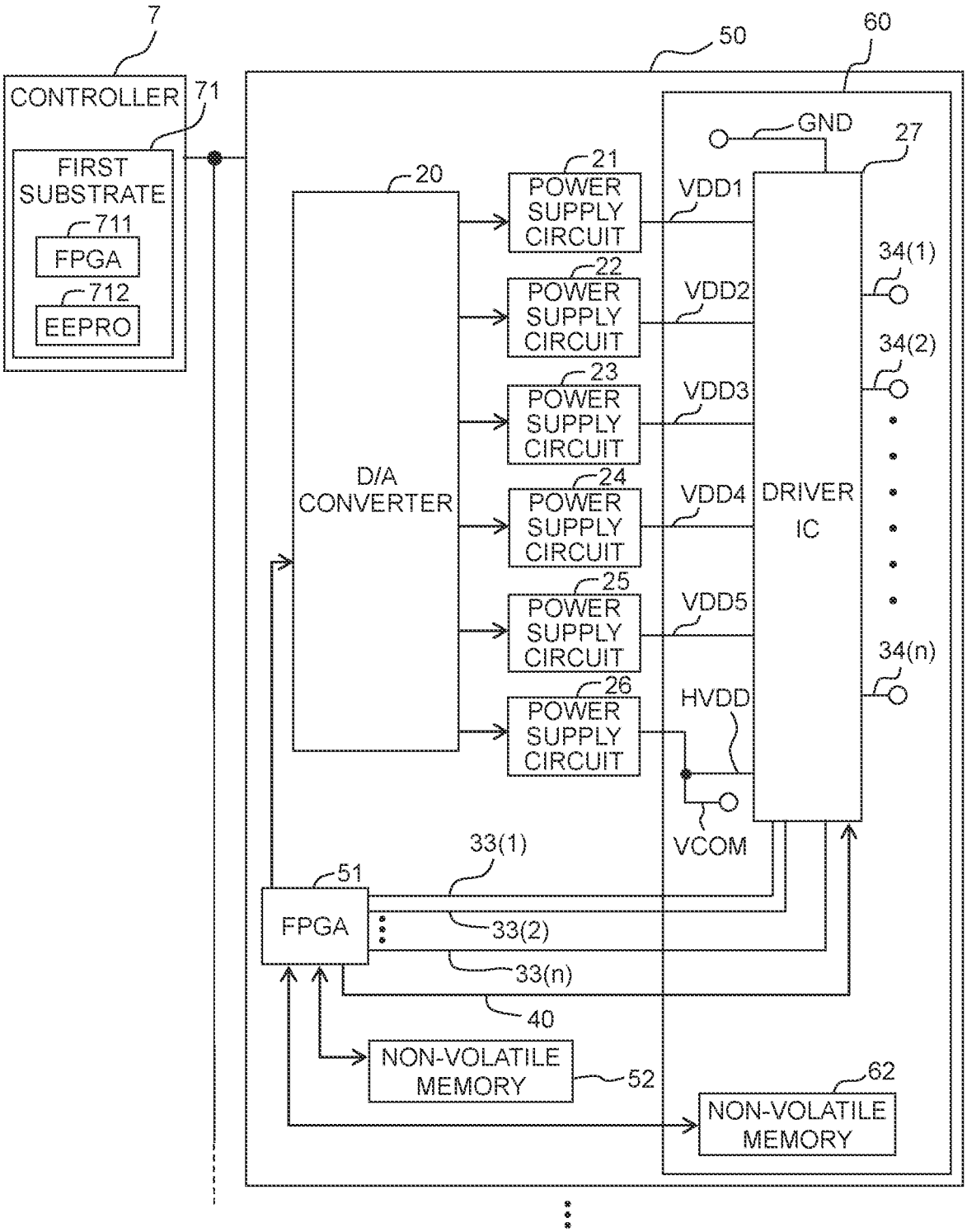
FIG. 3 is a block diagram of an exemplary configuration including a second substrate included in the head and a flexible circuit board connected to the second substrate according to this embodiment.

As depicted in FIG. 3, the controller 7 includes a first substrate 71. The first substrate 71 includes a Field Programmable Gate Array (FPGA) 771, a Read Only Memory (ROM, not depicted in FIG. 3), a Random Access Memory (RAM, not depicted in FIG. 3), an Electrically Erasable Programmable Read-Only Memory (EEPROM) 712, and the like. The controller 7 interacts or intercommunicates with an external apparatus 9, such as a personal computer. When the controller 7 receives an instruction from the external apparatus 9 or an operation section (not depicted) provided for the printing apparatus 1, the controller 7 controls operation of the line heads 4 and operation of the conveyance rollers 5A, 5B in accordance with a program(s) stored in the ROM. A Central Processing Unit (CPU) or a Microprocessor Unit (MPU) may be used instead of the FPGA 711.

For example, the controller 7 controls the motor, which drives the conveyance rollers 5A and 5B, to cause the conveyance rollers 5A and 5B to convey the print medium P in the conveyance direction. Further, the controller 7 controls each line head 4 to discharge ink onto the print medium P. Accordingly, an image is printed on the print medium P. The print medium P may be a roll-shaped print medium including a supply roll that has an upstream end in the conveyance direction and a recovery roll that has a downstream end in the conveyance direction. In this case, the supply roll may be attached to the conveyance roller 5A at the upstream side in the conveyance direction. The recovery roll may be attached to the conveyance roller 5B at the downstream side in the conveyance direction. Or, the print medium P may be a roll-shaped sheet only including the supply roll that has the upstream end in the conveyance direction. In this case, the supply roll may be attached to the conveyance roller 5A at the upstream side in the conveyance direction.

The casing 2 includes four head holding portions 8 corresponding to the four line heads 4. The head holding portions 8 are arranged above the platen 3 in a position between the conveyance rollers 5A and 5B. The head holding portions 8 are arranged in the front-rear direction. Each of the head holding portions 8 holds the corresponding one of the line heads 4.

The four line heads 4 respectively discharge inks of four colors of cyan (C), magenta (M), yellow (Y), and black (K). Each of the inks is supplied from corresponding one of ink tanks (not depicted) to corresponding one of the line heads 4.

As depicted in FIG. 1, each line head 4 of this embodiment includes ten heads 11. The ten heads 11 are arranged zigzag in the medium width direction to form two arrays. Since one color of ink is supplied to one line head 4, said one color of ink is discharged from the ten heads 11 included in said one line head 4. In this embodiment, the line head 4 includes the ten heads 11. The number of the heads 11, however, is not limited to ten.

Figure 2:
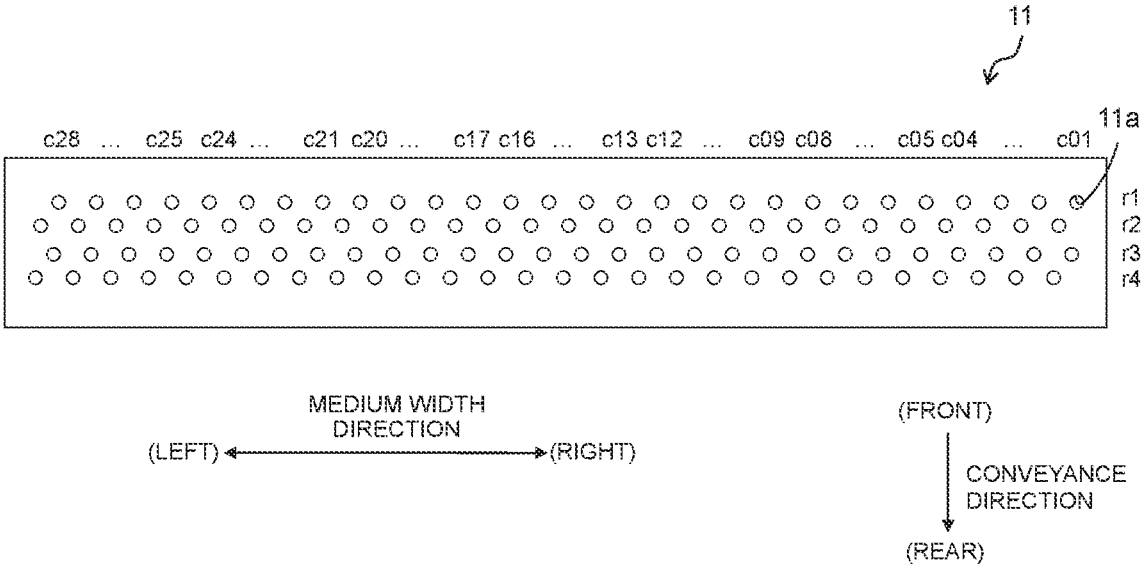
FIG. 2 is a bottom view of an exemplary head according to this embodiment.

As depicted in FIG. 2, 112 nozzles 11*a* are opened in a bottom surface of each head 11 in this embodiment. The 112 nozzles 11*a* form 28 nozzle arrays c01 to c28 arranged in the medium width direction. Each nozzle array is formed by four nozzles 11*a* arranged zigzag in a direction intersecting with the conveyance direction and the medium width direction. Positions in the conveyance direction of the respective nozzles 11*a* are defined as r1 to r4 from the front side toward the rear side in the conveyance direction. Each head 11 includes two manifolds (not depicted). Ink is supplied from one of the two manifolds to the nozzles 11*a* forming the nozzle arrays r1 and r2. Ink is supplied from the other of the two manifolds to the nozzles 11*a* forming the nozzle arrays r3 and r4. The position of each nozzle 11*a* in each head 11 is uniquely specified by the nozzle array to which each nozzle 11*a* belongs and the position in the conveyance direction. Although each head 11 includes the 112 nozzles 11*a* in this embodiment, the number of nozzles 11*a* is not limited to 112. Further, the number of nozzle arrays is not limited to 28, and the number of nozzles included in each nozzle array is not limited to four. The number of manifolds provided in each head 11 is not limited to two. One manifold may be provided for the nozzle arrays r1 to r4, or each of the manifolds may be provided for the corresponding one of the nozzle arrays r1 to r4 (i.e., four in total).

Each head 11 includes the same number of driving elements 111 (described below) as the nozzles 11*a*, a second substrate 50, and a flexible circuit board 60. The printing apparatus 1 of this embodiment includes the four line heads 4. Each line head 4 includes the ten heads 11. The printing apparatus 1 thus includes 40 heads 11. Accordingly, the number of the second substrates 50 is 40, and the number of flexible circuit boards 60 connected to the second substrates 50 is 40. Although only one second substrate 50 and one flexible circuit board 60 are depicted in FIG. 3 for convenience, the first substrate 71 of the controller 7 is connected to the 40 second substrates 50.

The second substrate 50 includes: a FPGA 51, a non-volatile memory 52 such as an EEPROM, a D/A converter 20, power supply circuits 21 to 26, and the like. Although the second substrate 50 includes the six power supply circuits 21 to 26 in this embodiment, the number of the power supply circuits is not limited to six. The flexible circuit board 60 includes a non-volatile memory 62 such as an EEPROM, a driver IC 27, and the like.

Under control of the FPGA 711 provided in the first substrate 71, the FPGA 51 outputs, to the D/A converter 20, a digital setting signal for setting an output voltage of each of the power supply circuits 21 to 26.

The D/A converter 20 converts the digital setting signal output from the FPGA 51 into an analog setting signal, and then outputs it to each of the power supply circuits 21 to 26.

Each of the power supply circuits 21 to 26 may be configured as a DC/DC converter made using electronic components, such as a FET, an inductor, a resistance, and an electrolytic capacitor. Each of the power supply circuits 21 to 26 outputs, to the driver IC 27, the output voltage designated by the setting signal. All of the power supply circuits 21 to 26 are set to have different output voltages in this embodiment. Specifically, the output voltage of the power supply circuit 21 is 22 V, the output voltage of the power supply circuit 22 is 21 V, the output voltage of the power supply circuit 23 is 20 V, the output voltage of the power supply circuit 24 is 19 V, the output voltage of the power supply circuit 25 is 18 V, and the output voltage of the power supply circuit 26 is 24 V.

The power supply circuit 21 is connected to the driver IC 27 via a trace VDD1. The power supply circuit 22 is connected to the driver IC 27 via a trace VDD2. The power supply circuit 23 is connected to the driver IC 27 via a trace VDD3. The power supply circuit 24 is connected to the driver IC 27 via a trace VDD4. The power supply circuit 25 is connected to the driver IC 27 via a trace VDD5. The power supply circuit 26 is connected to the driver IC 27 via a trace HVDD. The power supply circuit 26 is connected to each driving element 111 described below via a trace VCOM. The traces HVDD and VCOM are branched from an intermediate portion of a trace that is pulled out from the power supply circuit 26.

The power supply circuits 21 to 26 are respectively connected to waveform generating circuits 30(1) to 30(*n*) in the driver IC 27 (n is a natural number equal to or greater than 2, and n is equal to the number of the driving elements 111 in the head 11 (i.e., 112) in this embodiment).

The waveform generating circuits 30(1) to 30(*n*) are provided corresponding to n pieces of the driving element 111 in each head 11. That is, the waveform generating circuits 30(1) to 30(*n*) are provided corresponding to n pieces of the nozzle 11*a* in each head 11. The driver IC 27 is connected to n pieces of signal line 34(1) to 34(*n*). The driver IC 27 is connected to n pieces of the driving element 111 via n pieces of the signal line 34(1) to 34(*n*). Each signal line 34 is connected to an individual electrode of the corresponding driving element 111.

The driver IC 27 includes n pieces of selector 90(1) to 90(*n*) provided corresponding to n pieces of the driving element 111. The respective selectors 90 are components of hardware that is configured, for example, by a plurality of FETs formed in the driver IC 27.

The power supply circuit 26 can be used as a power supply voltage for the VCOM of the driving elements 111, or can be used as a high-side back gate voltage (HVDD) of PMOS transistors 311 to 315 described below.

The non-volatile memory 62 stores nozzle IDs for identifying the respective nozzles 11*a*, group IDs for identifying nozzle groups (described below) formed by the nozzles 11*a*, column IDs for identifying the nozzle arrays, row IDs for identifying positions in the conveyance direction of the nozzles 11*a*, and the like. Further, for example, as depicted in FIG. 8, a correspondence between n pieces of the nozzle 11*a* and the five power supply circuits 21 to 25, a correspondence between n pieces of the nozzle 11*a* and the groups (group IDs) g10 to g70, a correspondence between n pieces of the nozzle 11*a* and the nozzle arrays (columns IDs) c01 to c70, a correspondence between n pieces of the nozzle 11*a* and the positions in the conveyance direction (row IDs) r01 to r24, and the like are stored as a table T in the non-volatile memory 52. The table T may be stored in the non-volatile memory 62 provided in the flexible circuit board 60 instead of being stored in the non-volatile memory 52.

The driver IC 27 is connected to the FPGA 51 via a control line 40 and n pieces of control line 33(1) to 33(*n*). The control lines 33(1) to 33(*n*) are provided corresponding to n pieces of the waveform generating circuit 30(1) to 30(*n*). A signal for controlling the FET provided for each waveform generating circuit 30 is transmitted to each control line 33. Each waveform generating circuit 30 generates a driving signal for driving each driving element 111 in accordance with the above signal, and the driving signal generated is output to each driving element 111 via the corresponding signal line 34.

A control signal for controlling n pieces of the selector 90(1) to 90(*n*) in the driver IC 27 is transmitted to the control line 40. The FPGA 51 controls n pieces of the selector 90(1) to 90(*n*) and selects a power supply circuit for generating the driving signal to be output to each signal line 34.

Figure 4:
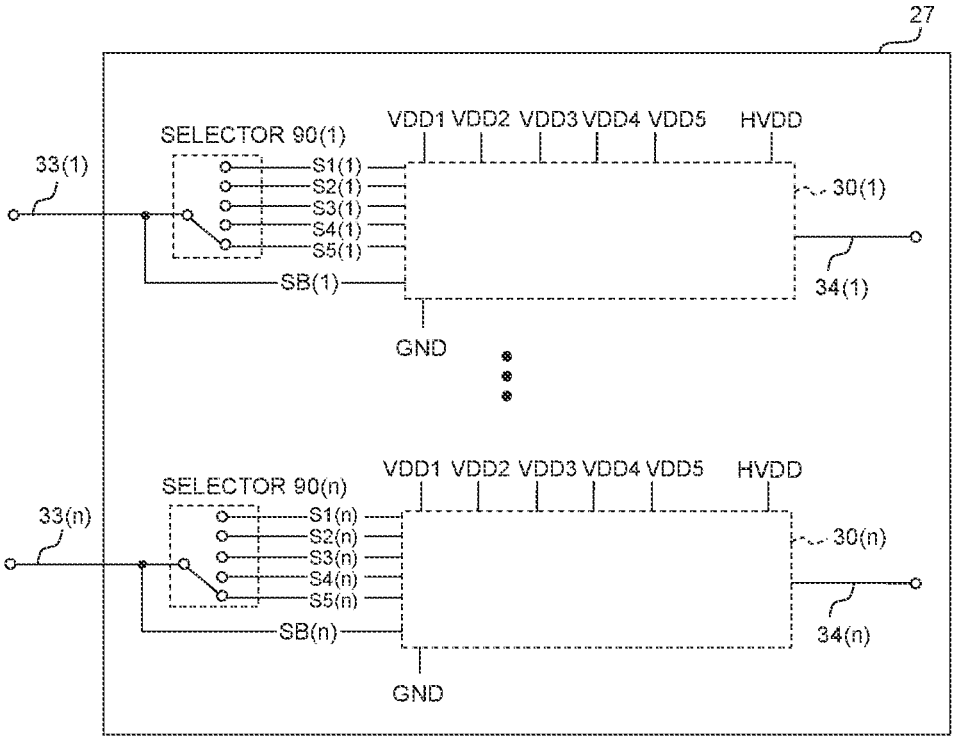
FIG. 4 depicts an exemplary circuit configuration provided in a driver IC.

Referring to FIG. 4, an exemplary configuration of the circuit in the driver IC 27 is explained below. As depicted in FIG. 4, the driver IC 27 includes n pieces of the waveform generating circuit 30(1) to 30(*n*), and n pieces of the selector 90(1) to 90(*n*) provided corresponding to the waveform generating circuits 30(1) to 30(*n*), respectively.

The driver IC 27 includes n pieces of the above configuration, the number of which is the same as the number of nozzles. Thus, the configuration of the circuit disposed between the control line 33(1) and the signal line 34(1) is explained below, as a representative. In the driver IC 27, the selector 90(1) and the waveform generating circuit 30(1) are formed between the control line 33(1) and the signal line 34(1).

The control line 33(1) from the FPGA 51 is connected to the selector 90(1). The control line 33(1) is branched from an intermediate portion of a route connecting the FPGA 51 and the selector 90(1), and a control line SB(1) branched from the intermediate portion of the control line 33(1) is connected to the waveform generating circuit 30(1).

The selector 90(1) is connected to the waveform generating circuit 30(1) via five control lines S1(1), S2(1), S3(1), S4(1), and S5(1). The selector 90(1) selects any one of the five control lines S1(1), S2(1), S3(1), S4(1), and S5(1) in accordance with an instruction from the FPGA 51, and connects the selected line to the control line 33(1).

The waveform generating circuit 30(1) is connected to five traces connected to the traces VDD1 to VDD5, a trace connected to the trace HVDD, and a trace connected to a trace GND.

Figure 5:
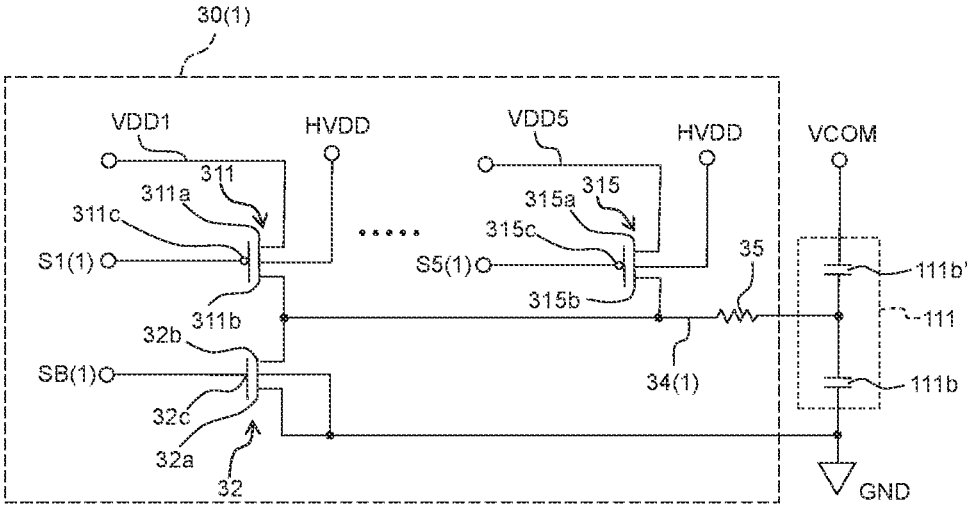
FIG. 5 depicts an exemplary configuration of a waveform generating circuit provided in the driver IC.

Referring to FIG. 5, an exemplary circuit configuration of the waveform generating circuits 30(1) to 30(*n*) provided for the head 11 according to this embodiment is explained below. Since the waveform generating circuits 30(1) to 30(*n*) have the same configuration, only the waveform generating circuit 30(1) is explained. The waveform generating circuit 30(1) includes five P-type Metal Oxide Semiconductor (PMOS) transistors 311 to 315 (only two transistors are depicted in FIG. 5), a N-type Metal Oxide Semiconductor (NMOS) transistor 32, a resistance 35, and the like. The waveform generating circuit 30(1) is connected to the individual electrode of the driving element 111 via the signal line 34(1).

Each driving element 111 of this embodiment is a piezoelectric element including a first active portion interposed between the individual electrode and a first constant potential electrode and a second active portion interposed between the individual electrode and a second constant potential electrode. Each of the driving elements 111 corresponds to one of pressure chambers. Each driving electrode 111 thus includes a capacitor 111*b* and a capacitor 111*b*'.

Five source terminals 311*a* to 315*a* of the PMOS transistors 311 to 315 are connected to the traces VDD 1 to VDD 5. A source terminal 32*a* of the NMOS transistor 32 is connected to ground. That is, the PMOS transistor 311 is connected to the power supply circuit 21 via the trace VDD1. The PMOS transistor 312 is connected to the power supply circuit 22 via the trace VDD2. The PMOS transistor 313 is connected to the power supply circuit 23 via the trace VDD3. The PMOS transistor 314 is connected to the power supply circuit 24 via the trace VDD4. The PMOS transistor 315 is connected to the power supply circuit 25 via the trace VDD5.

The control line S1(1) is connected to a gate terminal 311*c* of the PMOS transistor 311. The control line S2(1) is connected to a gate terminal 312*c* of the PMOS transistor 312. The control line S3(1) is connected to a gate terminal 313*c* of the PMOS transistor 313. The control line S4(1) is connected to a gate terminal 314*c* of the PMOS transistor 314. The control line S5(1) is connected to a gate terminal 315*c* of the PMOS transistor 315. The control line SB(1) is connected to a gate terminal 32*c* of the NMOS transistor 32.

Drain terminals 311*b* to 315*b* of the five PMOS transistors 311 to 315 are connected to a first end of the resistance 35. A drain terminal 32*b* of the NMOS transistor 32 is connected to the first end of the resistance 35. A second end of the resistance 35 is connected to the individual electrode of the driving element 111 (a second end of the capacitor 111*b*' and a first end of the capacitor 111*b*). The first constant potential electrode of the driving element 111 (a first end of the capacitor 111*b*') is connected to the VCOM, and the second constant potential electrode of the driving element 111 (a second end of the capacitor 111*b*) is connected to ground.

When the FPGA 51 outputs a low-level signal (L signal) to the control line 33(1), any one of the PMOS transistors 311 to 315 connected to the signal line selected by the selector 90(1) becomes an on state. The capacitor 111*b* is charged with a voltage supplied from any one of the power supply circuits 21 to 25, and the capacitor 111*b*' is discharged. When the FPGA 51 outputs a high-level signal (H signal) to the control line 33(1), the NMOS transistor 32 becomes an on state. The capacitor 111*b*' is charged with a voltage output from any one of the power supply circuits 21 to 25, and the capacitor 111*b* is discharged. The driving element 111 is deformed by alternatingly charging and discharging each of the capacitors 111*b* and 111*b*', which discharges or ejects ink from an opening of the corresponding nozzle 11*a*.

That is, the driving signal for driving the driving element 111 is output to the control line 34(1). The selector 90(1) selects any one of the five control lines S1(1) to S5(1) as the control line to be connected to the control line 33(1), which allows any one of the five power supply circuits 21 to 25 to be selected as the power supply circuit for generating the driving signal.

Figure 6:
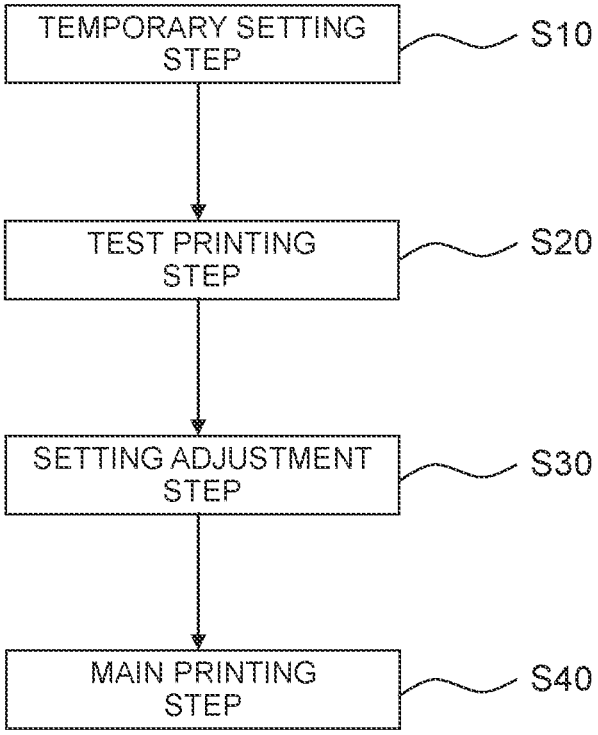
FIG. 6 is a flowchart indicating an outline of printing executed by the printing apparatus according to this embodiment.

Subsequently, a printing method using the printing apparatus 1 of this embodiment is explained below. As depicted in FIG. 6, the printing method using the printing apparatus 1 of this embodiment mainly includes a temporary setting step S10, a test printing step S20, a setting adjustment step S30, and a main printing step S40.

Figure 7:
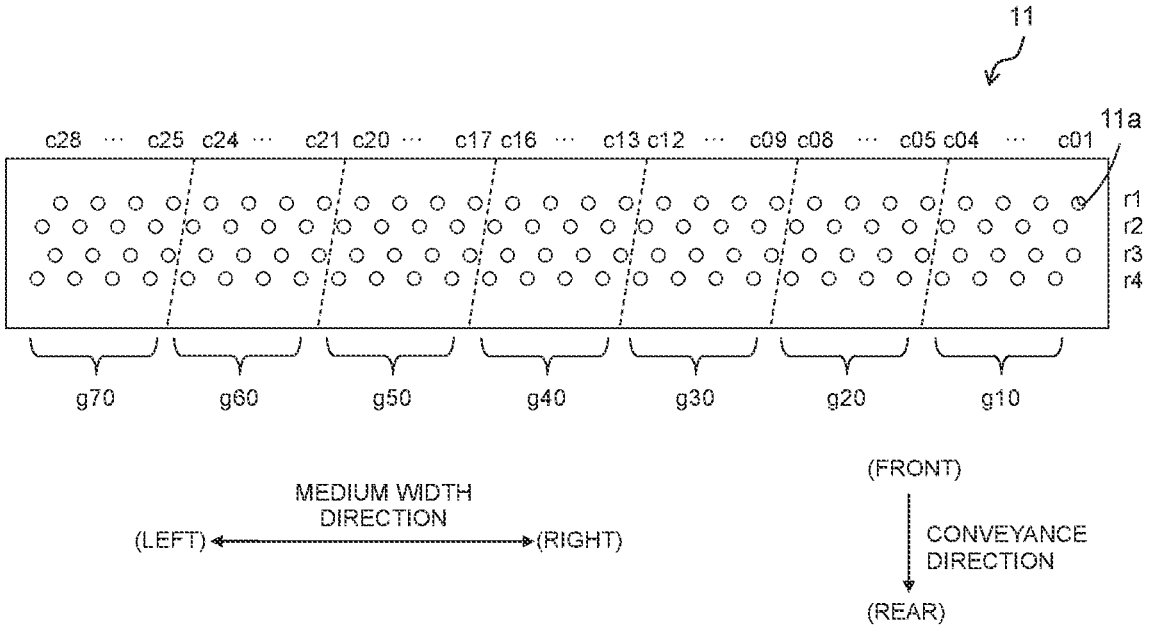
FIG. 7 depicts a state in which nozzles are classified into groups in a temporary setting process according to this embodiment.

In the temporary setting step S10, as depicted in FIG. 7, the 112 nozzles 11*a* are classified into the seven groups g10 to g70 for every 4 nozzle arrays. That is, the nozzles 11*a* belonging to the nozzle arrays c01 to c04 are associated with the group g10. The nozzles 11*a* belonging to the nozzle arrays c05 to c08 are associated with the group g20. The nozzles 11*a* belonging to the nozzle arrays c09 to c12 are associated with the group g30. The nozzles 11*a* belonging to the nozzle arrays c13 to c16 are associated with the group g40. The nozzles 11*a* belonging to the nozzle arrays c17 to c20 are associated with the group g50. The nozzles 11*a* belonging to the nozzle arrays c21 to c24 are associated with the group g60. The nozzles 11*a* belonging to the nozzle arrays c25 to c28 are associated with the group g70. The group g10 is adjacent to the group g20 in the medium width direction. The group g30 is adjacent to the group g20 in the medium width direction at a side opposite to the group g10. In this embodiment, the number of the power supply circuits 21 to 26 is six, which is smaller than the number of groups g10 to g 70 (i.e., seven). The number of the power supply circuits, however, may be the same as the number of the groups.

Subsequently, any of the power supply circuits 21 to 25 is associated with each of the groups so that the seven groups have uniform density of dots formed by ink droplets discharged from the nozzles 11*a*. For example, the power supply circuit 21 is associated with the nozzles 11*a* forming the groups g10, g20, g60, and g70, the power supply circuit 22 is associated with the nozzles 11*a* forming groups g30 and g50, and the power supply circuit 23 is associated with the nozzles 11*a* forming the group g40. The discharge characteristics of 112 nozzles 11*a* are affected by a slight error in a diameter of the nozzles 11*a*, a manufacturing error in the driving elements 111, residual stress in the heads 11 generated at the time of manufacture, and the like, which gradually changes the discharge characteristics of 112 nozzles 11*a* depending on the positions in the medium width direction and the conveyance direction. Thus, even if the same power supply circuit is associated with the nozzles 11*a* forming all the groups (i.e., the groups g10 to g70), the density of dots formed by ink droplets is not necessarily uniform.

Then, as depicted in FIG. 8, information about the positions (column ID, row ID) of the nozzle 11*a*, the group to which the nozzle 11*a* belongs, and the power supply circuit associated with the nozzle 11*a* is stored in the non-volatile memory 52 for each of the 112 nozzles 11*a*. In FIG. 8, v01 to v05 indicate identifies of the power supply circuits 21 to 25.

In the test printing step S20, test printing is executed on the print medium P in accordance with the association of the power supply circuit with each nozzle 11*a* set in the temporary setting step S10. Specifically, a voltage is supplied from the power supply circuit 21 to the driving elements 111 corresponding to the nozzles 11*a* included in the group g10. A voltage is supplied from the power supply circuit 22 to the driving elements 111 corresponding to the nozzles 11*a* included in the group g20. A voltage is supplied from the power supply circuit 23 to the driving elements 111 corresponding to the nozzles 11*a* included in the groups g30 to g50. A voltage is supplied from the power supply circuit 24 to the driving elements 111 corresponding to the nozzles 11*a* included in the group g60. A voltage is supplied from the power supply circuit 25 to the driving elements 111 corresponding to the nozzles 11*a* included in the group g70. Test printing is executed on the print medium P by discharging ink droplets from the 112 nozzles 11*a* included in the groups g10 to g70.

In the setting adjustment step S30, the association of the power supply circuit with each nozzle 11*a* set in the temporary setting step S10 is corrected based on the printing result in the test printing step S20. In the temporary setting step S10, the power supply circuits are associated with the nozzles for each group. Thus, in two groups adjacent to each other in the medium width direction, a density difference that can be seen with the naked eye may be caused between dots formed by ink droplets discharged from the nozzles 11*a* belonging to one of the two groups and dots formed by ink droplets discharged from the nozzles 11*a* belonging to the other. In view of this, in the setting adjustment step S30, a user observes the printing result in the test printing step S20 with the naked eye, and determines whether the density difference is generated in the two groups adjacent to each other in the medium width direction. When such a density difference is not generated (when the user sees no density difference with the naked eye), the association of the power supply circuits with the nozzles executed in the temporary setting step S10 is maintained, and the main printing step S40 is executed. When the density difference is generated (when the user sees the density difference with the naked eye), the association of the power supply circuits with the nozzles executed in the temporary setting step S10 is adjusted. A specific example thereof is explained below.

Figure 9A:
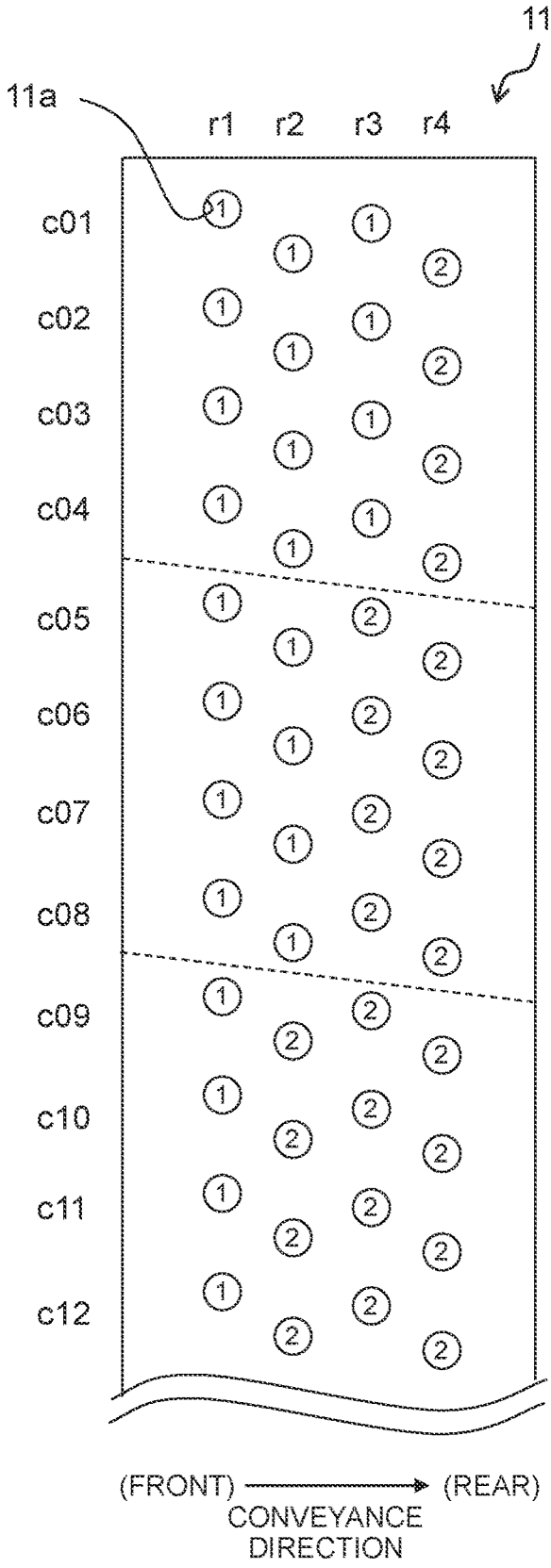
FIG. 9A depicts a state where association of power supply circuits with some of the nozzles is changed in a setting adjustment step according to this embodiment.

For example, when the user notices that the density difference is generated between the groups g10 and g20 and between the groups g20 and g30 depicted in FIG. 7 by observing the printing result in the test printing step S20 with the naked eye, the association of the power supply circuits with the nozzles 11*a* belonging to the groups g10, g20, and g30 is adjusted. For example, as depicted in FIG. 9A, in the group g10, the power supply circuit 21 associated with the nozzles 11*a* forming the nozzle array r4 is changed to the power supply circuit 22 having an output voltage that is the next smallest after the power supply circuit 21. In the group g20, the power supply circuit 21 associated with the nozzles 11*a* forming the nozzle array r3 and the nozzle array r4 is changed to the power supply circuit 22. In the group g30, the power supply circuit 22 associated with the nozzles 11*a* forming the nozzle array r1 is changed to the power supply circuit 21. As described above, the output voltages of the power supply circuits 21 to 25 are different from each other. The output voltage is sequentially decreased in the order of the power supply circuits 21, 22, 23, 24, and 25 (i.e., the power supply circuit 21 has the largest output voltage). Thus, in this embodiment, different natural numbers are associated with the power supply circuits 21 to 25. For example, a natural number n is associated with the power supply circuit 21, a natural number m different from the natural number n is associated with the power supply circuit 22, and a natural number I different from the natural numbers n and m is associated with the power supply circuit 23. Specifically, natural numbers 1 to 5 are associated with the power supply circuits 21 to 25. In FIG. 9A, a number in each circle indicating one of nozzles 11*a* indicates a natural number associated with the power supply circuit that is associated with the one of nozzles 11*a*. The power supply circuit associated with the nozzle is changed by rewriting a power supply circuit ID of the corresponding nozzle 11*a*. The power supply circuit ID is stored in the non-volatile memory 52 depicted in FIG. 8.

That is, in the setting adjustment step S30, the association of the power supply circuits with the nozzles is adjusted so that each of the groups g10 to g30 is formed by the nozzles 11*a* associated with the power supply circuit 21 and the nozzles 11*a* associated with the power supply circuit 22. Specifically, the group g10 includes 12 nozzles 11*a* forming the nozzle arrays r1 to r3 and four nozzles 11*a* forming the nozzle array r4. The power supply circuit 21 is associated with the 12 nozzles 11*a* forming the nozzle arrays r1 to r3, and thus the natural number 1 is associated with the 12 nozzles 11*a* forming the nozzle arrays r1 to r3. The power supply circuit 22 is associated with the four nozzles 11*a* forming the nozzle array r4, and thus the natural number 2 is associated with the four nozzles 11*a* forming the nozzle array r4. As a result, an average value A1 of the natural numbers associated with 16 nozzles 11*a* forming the group g10 is 1.25 (=(12+8)/16).

The group g20 includes eight nozzles 11*a* forming the nozzle arrays r1 and r2 and eight nozzles 11*a* forming the nozzle arrays r3 and r4. The power supply circuit 21 is associated with the eight nozzles 11*a* forming the nozzle arrays r1 and r2, and thus the natural number 1 is associated with the eight nozzles 11*a* forming the nozzle arrays r1 and r2. The power supply circuit 22 is associated with eight nozzles 11*a* forming the nozzle arrays r3 and r4, and thus the natural number 2 is associated with the eight nozzles 11*a* forming the nozzle arrays r3 and r4. As a result, an average value A2 of the natural numbers associated with 16 nozzles 11*a* forming the group g20 is 1.5 (=(8+16)/16).

The group g30 includes four nozzles 11*a* forming the nozzle array r1 and 12 nozzles 11*a* forming the nozzle arrays r2 to r4. The power supply circuit 21 is associated with the four nozzles 11*a* forming the nozzle array r1, and thus the natural number 1 is associated with the four nozzles 11*a* forming the nozzle array r1. The power supply circuit 22 is associated with 12 nozzles 11*a* forming the nozzle arrays r2 to r4, and thus the natural number 2 is associated with the 12 nozzles 11*a* forming the nozzle arrays r2 to r4. As a result, an average value A3 of the natural numbers associated with 16 nozzles 11*a* forming the group g30 is 1.75 (=(4+24)/16).

In the above setting adjustment step S30, the average value A1 (=1.25) of the values associated with the nozzles 11 forming the group g10 is different from the average value A2 (=1.5) of the values associated with the nozzles 11 forming the group g20, and an absolute value of a difference between the average value A1 and the average value A2 is less than one. Further, the average value A2 (=1.5) of the values associated with the nozzles 11*a* forming the group g20 is different from the average value A3 (=1.75) of the values associated with the nozzles 11*a* forming the group g30, and an absolute value of a difference between the average value A2 and the average value A3 is less than one. The average value A2 is a value between the average values A1 and A3.

In the main printing step S40, a voltage is supplied to the driving element 111 corresponding to each nozzle 11*a* in accordance with the association information of the power supply circuit stored in the non-volatile memory 52. Then, printing is executed on the print medium P by discharging ink droplets from the 112 nozzles 11*a* included in the groups g10 to g70.

Figure 9B:
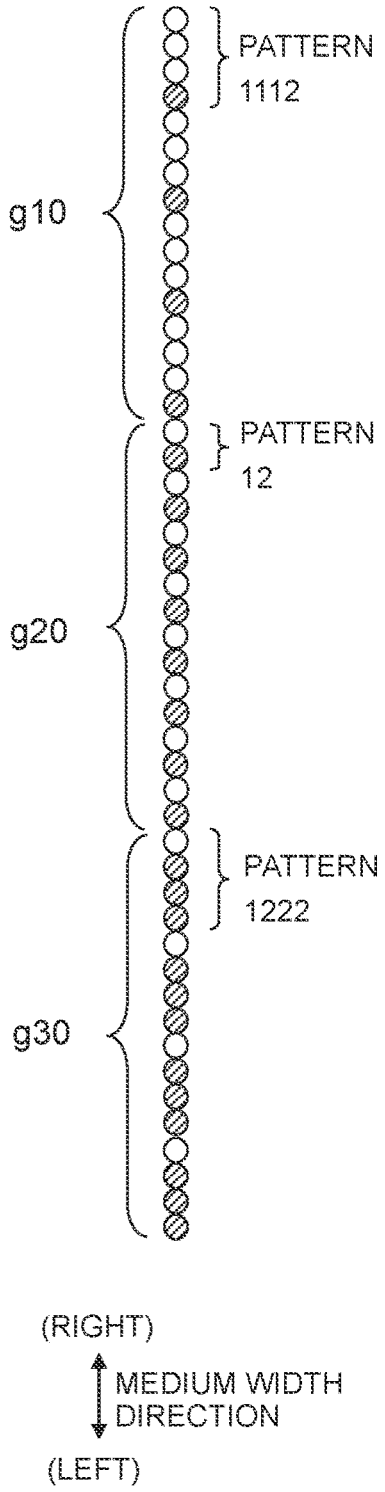
FIG. 9B depicts part of a dot array formed by discharging ink droplets from all the nozzles in the head after the change in association of the power supply circuits with the nozzles.

For example, one dot array extending in the medium conveyance direction as depicted in FIG. 9B is formed on the print medium P by discharging ink droplets from the nozzles 11*a* belonging to the groups g10 to g30. In FIG. 9B, one dot formed by an ink droplet discharged from one nozzle 11*a* is indicated by one circle. White circles indicate dots formed by ink droplets discharged from the nozzles 11*a* with which the natural number 1 is associated (hereinafter referred to as "dot 1"). Hatched circles indicate dots formed by ink droplets discharged from the nozzles 11*a* with which the natural number 2 is associated (hereinafter referred to as "dot 2").

As depicted in FIG. 9B, the group g10 includes patterns (hereinafter referred to as "patterns 1112") each of which is formed by three dots 1 and one dot 2. The pattern 1112 is repeated (periodically) four times in the medium width direction so that the patterns 1112 are arranged in the medium width direction. The group g20 includes patterns (hereinafter referred to as "patterns 12") each of which is formed by one dot 1 and one dot 2. The pattern 12 is repeated (periodically) eight times in the medium width direction so that the patterns 12 are arranged in the medium width direction. The group g30 includes patterns (hereinafter referred to as "patterns 1222") each of which is formed by one dot 1 and three dots 2. The pattern 1222 is repeated (periodically) four times in the medium width direction so that the patterns 1222 are arranged in the medium width direction. In this embodiment, the pattern 1112 is repeated every 0.084 mm in the group g10, the pattern 12 is repeated every 0.042 mm in the group g20, and the pattern 1222 is repeated every 0.084 mm in the group g30. Experiments performed by the inventors(s) revealed that human beings can not notice the patterns repeated periodically when the patterns are repeated every 0.16 mm or less. However, it is desired that the patterns are repeated every 0.1 mm or less.

In the above specified example, the group g10 is an exemplary "first group" of the present disclosure, the group g20 is an exemplary "second group" of the present disclosure, and the group g30 is an exemplary "third group" of the present disclosure. In the temporary setting step S10, the power supply circuit 21 associated with the groups g10 and g20 is an exemplary "first power supply circuit" of the present disclosure, and the power supply circuit 22 associated with the group g30 is an exemplary "second power supply circuit" of the present disclosure. A dot array formed by discharging ink droplets from all the nozzles 11*a* forming the group g10 is an exemplary "first dot array" of the present disclosure. A dot array formed by discharging ink droplets from all the nozzles 11*a* forming the group g20 is an exemplary "second dot array" of the present disclosure. Further, the pattern 1112 is an exemplary "first pattern" of the present disclosure, and the pattern 12 is an exemplary "second pattern" of the present disclosure.

In the above embodiment, when the user notices that the density difference is generated in two groups adjacent to each other in the medium width direction by observing the printing result in the test printing step S20 with the naked eye, the association of the power supply circuits with some of the nozzles forming each group is changed. Specifically, in each group, a certain power supply circuit associated with some of the nozzles 11*a* in the temporary setting step S10 is changed to a power supply circuit in which output voltage is the next smallest after the certain power supply circuit, or to a power supply circuit in which output voltage is the next largest after the certain power supply circuit. This reduces a density difference between dots formed by nozzles belonging to the same group and reduces a density difference between two groups adjacent to each other in the medium width direction without changing the output voltage of each power supply circuit.

In the above embodiment, in two groups adjacent to each other in the medium width direction, the average value A1 of the values of the natural numbers associated with the nozzles 11*a* forming one of the two groups is different from the average value A2 of the values of the natural numbers associated with the nozzles 11*a* forming the other. The absolute value of the difference between the average value A1 and the average value A2 is less than one. Thus, it is possible to execute the adjustment more accurately than a case where the same power supply circuit is associated with the nozzles 11*a* forming each group (i.e., the case of the temporary setting step S10).

In the above embodiment, when the first group, the second group, and the third group are adjacent to each other in the medium width direction in this order, the average value A2 of the values of the natural numbers associated with the nozzles 11*a* forming the second group is a value between the average value A1 of the values of the natural numbers associated with the nozzles 11*a* forming the first group and the average value A3 of the values of the natural numbers associated with the nozzles 11*a* forming the third group. This can smoothly alleviate distribution tendency of the density difference in the head 11.

In the above embodiment, for example, the pattern 1112 is repeated at the interval of 0.084 mm in the group g10, the pattern 12 is repeated at the interval of 0.042 mm in the group g20, and the pattern 1222 is repeated at the interval of 0.084 mm in the group g30. That is, in each group, the patterns are repeated periodically at intervals of equal to or less than 0.1 mm. Thus, even when the patterns are repeated periodically, it is not perceptible as density unevenness by human vision.

The embodiment as described above is merely an example of the present disclosure, and may be modified as appropriate. For example, in each group, the number of the nozzles 11*a* for which the exchange of the power supply circuits is executed and the positions of the nozzles 11*a* for which the exchange of the power supply circuits is executed may be changed appropriately. In the above embodiment, the pattern 1112 is repeated four times in the group g10, and the pattern 12 is repeated eight times in the group g20. The present disclosure, however, is not limited thereto. The pattern 1112 may be repeated in at least part of the dot array formed by discharging ink droplets from all the nozzles forming the group g10, and the pattern 12 may be repeated in at least part of the dot array formed by discharging ink droplets from all the nozzles forming the group g20.

Figure 10:
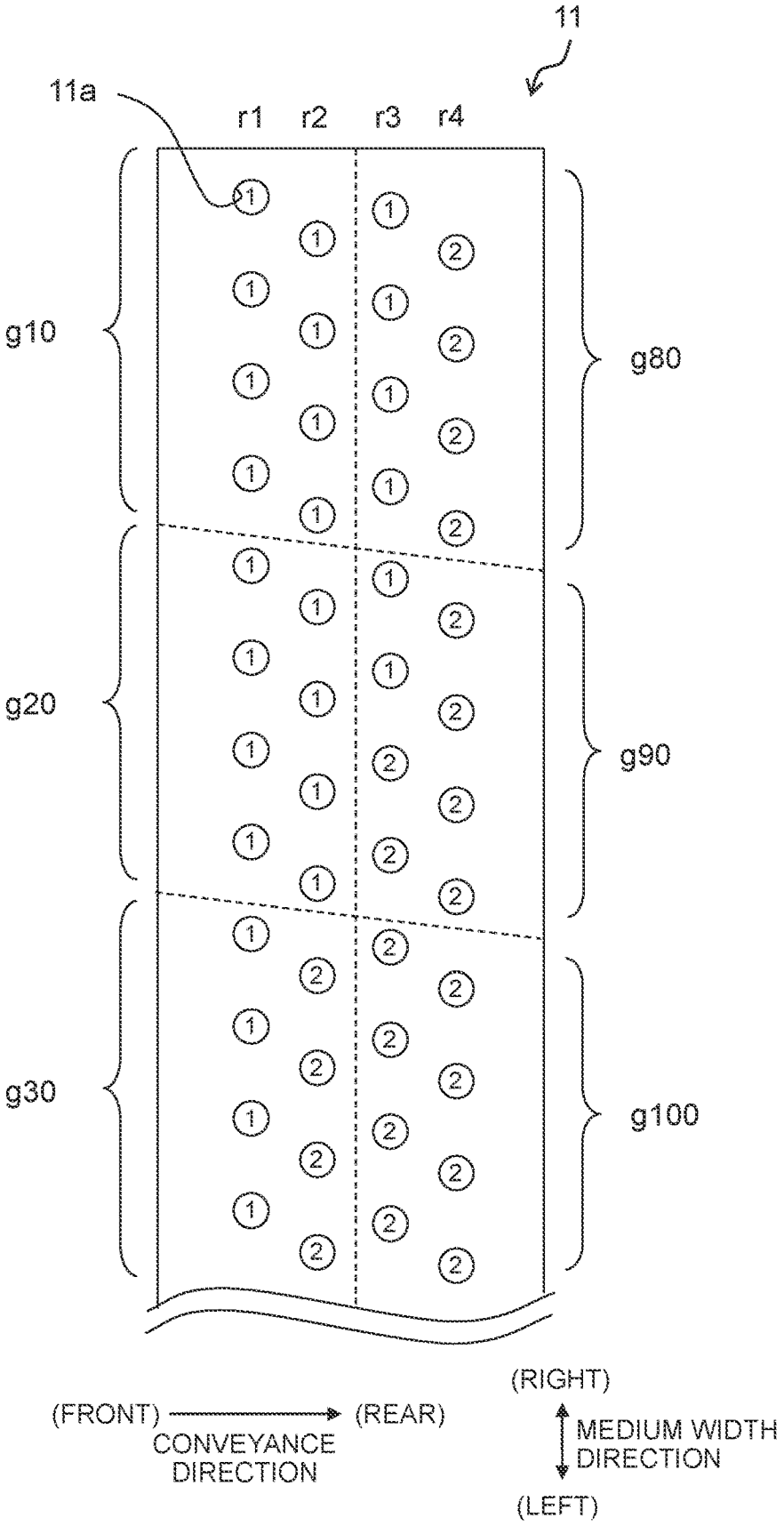
FIG. 10 depicts a modified example of the head of this embodiment.

In the above embodiment, the 112 nozzles 11*a* included in each head 11 are classified into the seven groups in the medium width direction. The present disclosure, however, is not limited thereto. The 112 nozzles 11*a* included in each head 11 may be further divided in the conveyance direction. For example, as depicted in FIG. 10, the 112 nozzles 11*a* included in each head 11 may be divided into groups g10 to g70 at the front side in the conveyance direction and groups g80 to g140 at the rear side in the conveyance direction by further dividing the 112 nozzles 11*a* included in each head 11 in the conveyance direction. That is, the groups g10 to g70 are respectively adjacent to the groups g80 to g140 in the conveyance direction. In this case, it is possible to reduce the density difference between two groups adjacent to each other in the conveyance direction by adjusting the association of the power supply circuits with the nozzles similarly to the above embodiment, not only in the two groups adjacent to each other in the medium width direction but also in the two groups adjacent to each other in the conveyance direction. In this modified example, the group g10 is an exemplary "first group" of the present disclosure, the group g20 is an exemplary "second group" of the present disclosure, the group g80 is an exemplary "fourth group" of the present disclosure, and the group g90 is an exemplary "fifth group" of the present disclosure.

In the modified example depicted in FIG. 10, the group g10 includes eight nozzles 11*a* forming the nozzle arrays r1 and r2. The power supply circuit 21 is associated with the eight nozzles 11*a* forming the nozzle arrays r1 and r2, and thus the natural number 1 is associated with the eight nozzles 11*a* forming the nozzle arrays r1 and r2. As a result, the average value A1 of the natural numbers associated with the eight nozzles 11*a* forming the group g10 is 1 (=8/8). The same is applied to the group g20, that is, the average value A2 of the natural numbers is 1 (=8/8). The group g30 includes four nozzles 11*a* forming the nozzle array r1 and four nozzles 11*a* forming the nozzle array r2. The power supply circuit 21 is associated with the four nozzles 11*a* forming the nozzle array r1, and thus the natural number 1 is associated with the four nozzles 11*a* forming the nozzle array r. Further, the power supply circuit 22 is associated with the four nozzles 11*a* forming the nozzle array r2, and thus the natural number 2 is associated with the four nozzles 11*a* forming the nozzle array r2. As a result, the average value A3 of the natural numbers associated with the eight nozzles 11*a* forming the group g30 is 1.5 (=(4+8)/8). The group g80 includes eight nozzles 11*a* forming the nozzle arrays r3 and r4. The power supply circuit 21 is associated with four nozzles 11*a* forming the nozzle array r3, and thus the natural number 1 is associated with the four nozzles 11*a* forming the nozzle array r3. Further, the power supply circuit 22 is associated with four nozzles 11*a* forming the nozzle array r4, and thus the natural number 2 is associated with the four nozzles 11*a* forming the nozzle array r4. As a result, the average value A4 of the natural numbers associated with the eight nozzles 11*a* forming the group g80 is 1.5 (=(4+8)/8). The group g90 includes eight nozzles 11*a* forming the nozzle arrays r3 and r4. The power supply circuit 21 is associated with two nozzles 11*a* forming the nozzle array r3, and thus the natural number 1 is associated with the two nozzles 11*a* forming the nozzle array r3. The power supply circuit 22 is associated with two nozzles 11*a* forming the nozzle array r3 and four nozzles 11*a* forming the nozzle array r4, and thus the natural number 2 is associated with the two nozzles 11*a* forming the nozzle array r3 and the four nozzles 11*a* forming the nozzle array r4. As a result, the average value A5 of the natural numbers associated with the eight nozzles 11*a* forming the group g90 is 1.75 (=14/8). The group g100 includes eight nozzles 11*a* forming the nozzle arrays r3 and r4. The power supply circuit 22 is associated with the eight nozzles 11*a* forming the nozzle arrays r3 and r4, and thus the natural number 2 is associated with the eight nozzles 11*a* forming the nozzle arrays r3 and r4. As a result, the average value A6 of the natural numbers associated with the eight nozzles 11*a* forming the group g100 is 2 (=16/8). Thus, a difference between the average values A4 and A1 and a difference between the average values A5 and A2 have the same code (positive values in this modified example). Further, the difference between the average values A5 and A2 and a difference between the average values A6 and A3 have the same code (positive values in this modified example).

Figure 11:
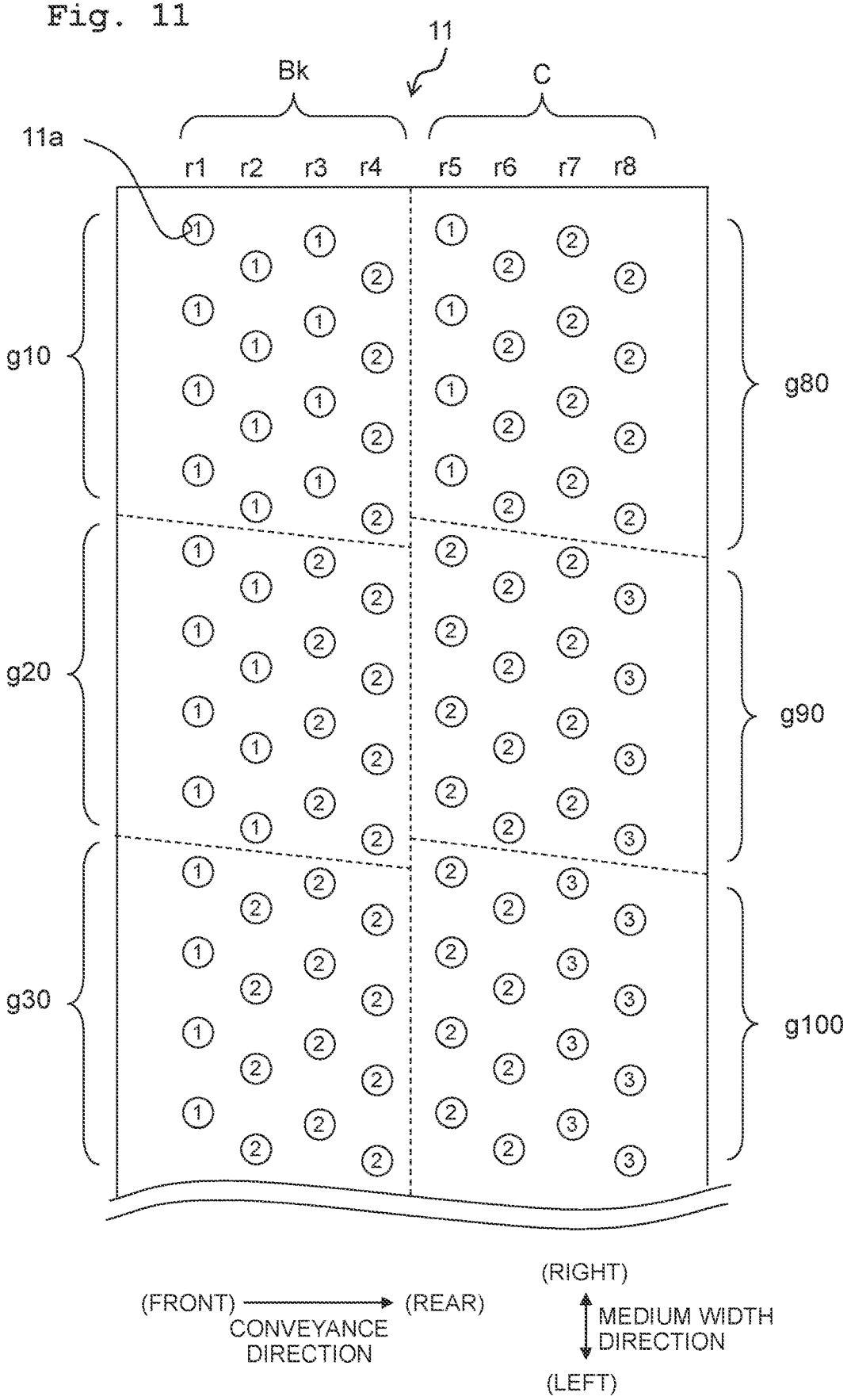
FIG. 11 depicts another modified example of the head of this embodiment.

In the above embodiment, only one color of ink is discharged from one head 11. The present disclosure, however, is not limited thereto. For example, as depicted in FIG. 11, one head 11 may include eight nozzle arrays arranged in the conveyance direction. The black ink may be discharged from four nozzle arrays r1 to r4 positioned at the front side in the conveyance direction and the cyan ink may be discharged from four nozzle arrays r5 to r8 positioned at the rear side in the conveyance direction. In this case, the head 11 includes a first manifold, a second manifold, a third manifold, and a fourth manifold (the manifolds are not depicted in the drawings). The black ink is supplied from the first manifold to the two nozzle arrays r1 and r2. The black ink is supplied from the second manifold to the two nozzle arrays r3 and r4. The cyan ink is supplied from the third manifold to the two nozzle arrays r5 and r6. The cyan ink is supplied from the fourth manifold to the two nozzle arrays r7 and r8. Similar to the above embodiment, the nozzles 11*a* forming the four nozzle arrays positioned at the front side in the conveyance direction may be classified into seven groups g10 to g70 in the medium width direction, and the nozzles 11*a* forming the four nozzle arrays positioned at the rear side in the conveyance direction may be classified into seven groups g80 to g140 in the medium width direction. Then, the association of the power supply circuits with the groups g10 to g70 may be adjusted similarly to the above embodiment, and the association of the power supply circuits with the groups g80 to g140 may be adjusted similarly to the above embodiment. In this modified example, the black ink is an exemplary "first liquid" of the present disclosure, and the cyan ink is an exemplary "second liquid" of the present disclosure. In this modified example, the magenta ink may be used instead of the black ink, and the yellow ink may be used instead of the cyan ink.

In the modified example depicted in FIG. 11, the group g10 includes 12 nozzles 11*a* forming the nozzle arrays r1 to r3 and four nozzles 11*a* forming the nozzle array r4. The power supply circuit 21 is associated with the 12 nozzles 11*a* forming the nozzle arrays r1 to r3, and thus the natural number 1 is associated with the 12 nozzles 11*a* forming the nozzle arrays r1 to r3. The power supply circuit 22 is associated with the four nozzles 11*a* forming the nozzle array r4, and thus the natural number 2 is associated with the four nozzles 11*a* forming the nozzle array r4. As a result, the average value A1 of the natural numbers associated with the 16 nozzles 11*a* forming the group g10 is 1.25 (=(12+8)/16). The group g20 includes eight nozzles 11*a* forming the nozzle arrays r1 and r2 and eight nozzles 11*a* forming the nozzle arrays r3 and r4. The power supply circuit 21 is associated with the eight nozzles 11*a* forming the nozzle arrays r1 and r2, and thus the natural number 1 is associated with the eight nozzles 11*a* forming the nozzle arrays r1 and r2. The power supply circuit 22 is associated with the eight nozzles 11*a* forming the nozzle arrays r3 and r4, and thus the natural number 2 is associated with the eight nozzles 11*a* forming the nozzle arrays r3 and r4. As a result, the average value A2 of the natural numbers associated with the 16 nozzles 11*a* forming the group g20 is 1.5 (=(8+16)/16). The group g30 includes four nozzles 11*a* forming the nozzle array r1 and 12 nozzles 11*a* forming the nozzle arrays r2 to r4. The power supply circuit 21 is associated with the four nozzles 11*a* forming the nozzle array r1, and thus the natural number 1 is associated with the four nozzles 11*a* forming the nozzle array r1. The power supply circuit 22 is associated with the 12 nozzles 11*a* forming the nozzle arrays r2 to r4, and thus the natural number 2 is associated with the 12 nozzles 11*a* forming the nozzle arrays r2 to r4. As a result, the average value A3 of the natural numbers associated with the 16 nozzles 11*a* forming the group g30 is 1.75 (=(4+24)/16). The group g80 includes four nozzles 11*a* forming the nozzle array r5 and 12 nozzles 11*a* forming the nozzle arrays r6 to r8. The power supply circuit 21 is associated with the four nozzles 11*a* forming the nozzle array r5, and thus the natural number 1 is associated with the four nozzles 11*a* forming the nozzle array r5. The power supply circuit 22 is associated with the 12 nozzles 11*a* forming the nozzle arrays r6 to r8, and thus the natural number 2 is associated with the 12 nozzles 11*a* forming the nozzle arrays r6 to r8. As a result, the average value A4 of the natural numbers associated with the 16 nozzles 11*a* forming the group g80 is 1.75 (=(4+24)/16). The group g9) includes 12 nozzles 11*a* forming the nozzle arrays r5 to r7 and four nozzles 11*a* forming the nozzle array r8. The power supply circuit 22 is associated with the 12 nozzles 11*a* forming the nozzle arrays r5 to r7, and thus the natural number 2 is associated with the 12 nozzles 11*a* forming the nozzle arrays r5 to r7. The power supply circuit 23 is associated with the four nozzles 11*a* forming the nozzle array r8, and thus the natural number 3 is associated with the four nozzles 11*a* forming the nozzle array r8. As a result, the average value A5 of the natural numbers associated with the 16 nozzles 11*a* forming the group g90 is 2.25 (=(24+12)/16). The group g100 includes eight nozzles 11*a* forming the nozzle arrays r5 and r6 and eight nozzles 11*a* forming the nozzle arrays r7 and r8. The power supply circuit 22 is associated with the eight nozzles 11*a* forming the nozzle arrays r5 and r6, and thus the natural number 2 is associated with the eight nozzles 11*a* forming the nozzle arrays r5 and r6. The power supply circuit 23 is associated with the eight nozzles 11*a* forming the nozzle arrays r7 and r8, and thus the natural number 3 is associated with the eight nozzles 11*a* forming the nozzle arrays r7 and r8. As a result, the average value A6 of the natural numbers associated with the 16 nozzles 11*a* forming the group g100 is 2.5 (=(16+24)/16). Thus, a difference between the average value A4 and the average value A1, a difference between the average value A5 and the average value A2, and a difference between the average value A6 and the average value A3 have the same code (positive values in this modified example). According to this modified example, also in a head capable of discharging two inks that are greatly different in physical properties such as viscosity from each other, it is possible to reduce a density difference between two groups adjacent to each other in the medium width direction. In this modified example, the power supply circuit 23 associated with the natural number 3 is an exemplary "third power supply circuit" of the present disclosure.

In the above embodiment, the association of the power supply circuits with the nozzles is temporarily set in the temporary setting step S10, and test printing is executed in the test printing step S20. Then, in the setting adjustment step S30, the association of the power supply circuits with the nozzles is adjusted based on the printing result of the test printing step S20. The present disclosure, however, is not limited thereto. For example, after the temporary setting step S10, the main printing step S40 may be executed without executing the test printing step S20 and the setting adjustment step S30. During the main printing step S40, the association of the power supply circuits with the nozzles may be adjusted depending on the printing result. In this case, a density sensor may be provided at a downstream side of the four line heads 4 in the conveyance direction, and the density sensor may detect density at positions in the medium width direction during main printing. When a density difference between two groups adjacent to each other in the medium width direction exceeds a predefined threshold value, the association of the power supply circuits with some of the nozzles belonging to said two groups may be changed.

Figure 12:
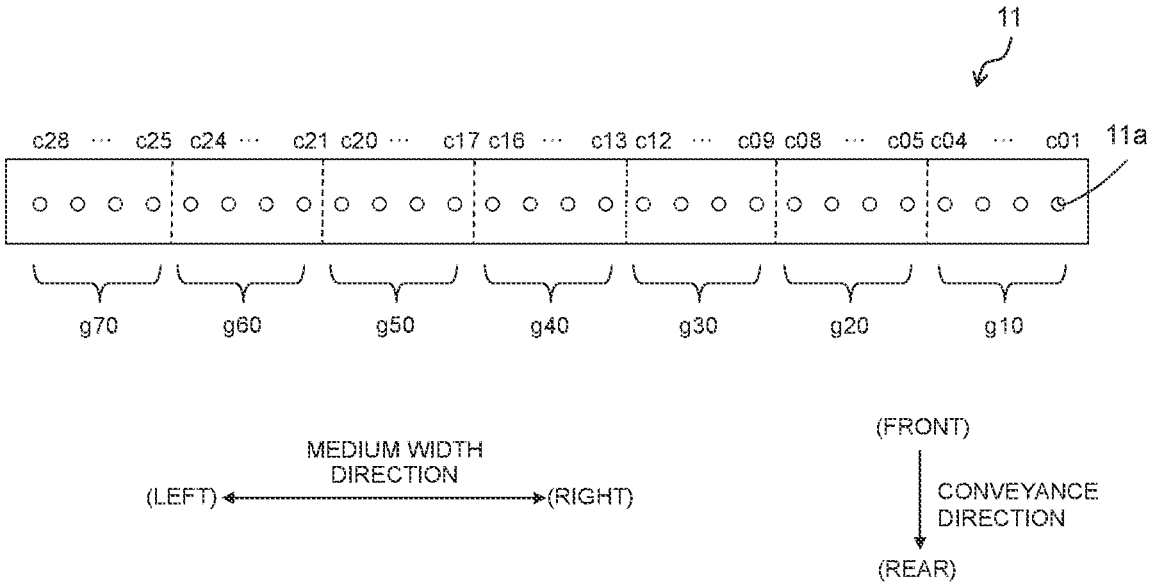
FIG. 12 is a plan view of still another modified example of the head of this embodiment.

In the above embodiment and the modified examples, the nozzle arrays are arranged in the conveyance direction in the head 11. The present disclosure, however, is not limited thereto. For example, as depicted in FIG. 12, only one nozzle array may be formed along the medium width direction in the head 11. The one nozzle array may be divided into seven groups g10 to g70 in the medium width direction.

In the above embodiment, the printing apparatus 1 executes printing on the print medium P by a line head system in which ink is discharged from the line heads 4 that are fixed to the printing apparatus 1 and that are long in the medium width direction. However, the printing apparatus 1 may execute printing on the print medium P by a serial head system in which the heads 11 are carried on a carriage to move in the medium width direction together with the carriage.

In the above embodiment, the print medium P is conveyed with the line heads 4 being fixed to the printing apparatus 1. The present disclosure, however, is not limited thereto. It is only required that the print medium P moves relative to the line heads 4. For example, the line heads 4 may be configured to move relative to the fixed print medium P.

What is claimed is:

1. A printing apparatus, comprising:

a plurality of power supply circuits including at least a first power supply circuit and a second power supply circuit, the power supply circuits having mutually different output voltages;

a head including a plurality of nozzles, the nozzles forming a plurality of groups arranged in a first direction, each of the nozzles being associated with any one of the power supply circuits;

wherein the groups include a first group and a second group adjacent to each other in the first direction, the first group is formed by a plurality of nozzles associated with the first power supply circuit and a plurality of nozzles associated with the second power supply circuit, the second group is formed by a plurality of nozzles associated with the first power supply circuit and a plurality of nozzles associated with the second power supply circuit, a natural number value n is associated with the first power supply circuit, a natural number value m, which is different from the value n, is associated with the second power supply circuit, in the first group, the value n is associated with the nozzles which are associated with the first power supply circuit, and the value m is associated with the nozzles which are associated with the second power supply circuit, in the second group, the value n is associated with the nozzles which are associated with the first power supply circuit, and the value m is associated with the nozzles which are associated with the second power supply circuit, and an average value A1 of values associated with the nozzles forming the first group is different from an average value A2 of values associated with the nozzles forming the second group.

2. The printing apparatus according to claim 1, wherein an absolute value of a difference between the average value A1 and the average value A2 is less than one.

3. The printing apparatus according to claim 1, further including a memory configured to store information indicating a correspondence between the nozzles and the groups and a correspondence between the nozzles and the power supply circuits, wherein printing is executed by driving the head based on the information.

4. The printing apparatus according to claim 1, wherein the number of the power supply circuits is equal to or less than the number of the groups.

5. A printing apparatus, comprising:

a plurality of power supply circuits including at least a first power supply circuit and a second power supply circuit, the power supply circuits having mutually different output voltages;

a head including a plurality of nozzles, the nozzles forming a plurality of groups arranged in a first direction, each of the nozzles being associated with any one of the power supply circuits;

wherein the groups include a first group and a second group adjacent to each other in the first direction, the first group is formed by a plurality of nozzles associated with the first power supply circuit and a plurality of nozzles associated with the second power supply circuit, the second group is formed by a plurality of nozzles associated with the first power supply circuit and a plurality of nozzles associated with the second power supply circuit, the groups further include a third group that is adjacent to the second group in the first direction at a side opposite to the first group, the third group is formed by a plurality of nozzles associated with the first power supply circuit and a plurality of nozzles associated with the second power supply circuit, a natural number value n is associated with the first power supply circuit, a natural number value m, which is different from the value n, is associated with the second power supply circuit, in the first group, the value n is associated with the nozzles which are associated with the first power supply circuit, and the value m is associated with the nozzles which are associated with the second power supply circuit, in the second group, the value n is associated with the nozzles which are associated with the first power supply circuit, and the value m is associated with the nozzles which are associated with the second power supply circuit, in the third group, the value n is associated with the nozzles which are associated with the first power supply circuit, and the value m is associated with the nozzles which are associated with the second power supply circuit, an average value A1 is an average of values associated with the nozzles forming the first group and an average value A2 is an average of values associated with the nozzles forming the second group, and the average value A2 is a value between the average value A1 and an average value A3 of values associated with the nozzles forming the third group.

6. The printing apparatus according to claim 5, wherein the nozzles form a plurality of nozzle arrays arranged in a second direction that intersects with the first direction, and each of the nozzles included in each of the nozzle arrays belongs to any one of the groups.

7. The printing apparatus according to claim 5, wherein the groups further include a fourth group that is adjacent to the first group at a side in a second direction intersecting with the first direction and a fifth group that is adjacent to the second group at the side in the second direction.

8. The printing apparatus according to claim 5, further including a memory configured to store information indicating a correspondence between the nozzles and the groups and a correspondence between the nozzles and the power supply circuits, wherein printing is executed by driving the head based on the information.

9. The printing apparatus according to claim 5, wherein the number of the power supply circuits is equal to or less than the number of the groups.

10. A printing apparatus, comprising:

a plurality of power supply circuits including at least a first power supply circuit and a second power supply circuit, the power supply circuits having mutually different output voltages;

a head including a plurality of nozzles, the nozzles forming a plurality of groups arranged in a first direction, each of the nozzles being associated with any one of the power supply circuits;

wherein the groups include a first group and a second group adjacent to each other in the first direction, the first group is formed by a plurality of nozzles associated with the first power supply circuit and a plurality of nozzles associated with the second power supply circuit, the second group is formed by a plurality of nozzles associated with the first power supply circuit and a plurality of nozzles associated with the second power supply circuit, the groups further include a fourth group that is adjacent to the first group at a side in a second direction intersecting with the first direction and a fifth group that is adjacent to the second group at the side in the second direction, the fourth group is formed by a plurality of nozzles associated with the first power supply circuit and a plurality of nozzles associated with the second power supply circuit, the fifth group is formed by a plurality of nozzles associated with the first power supply circuit and a plurality of nozzles associated with the second power supply circuit, a natural number value n is associated with the first power supply circuit, a natural number value m, which is different from the value n, is associated with the second power supply circuit, in the first group, the value n is associated with the nozzles which are associated with the first power supply circuit, and the value m is associated with the nozzles which are associated with the second power supply circuit, in the second group, the value n is associated with the nozzles which are associated with the first power supply circuit, and the value m is associated with the nozzles which are associated with the second power supply circuit, in the fourth group and the fifth group, the value n is associated with the nozzles which are associated with the first power supply circuit, and the value m is associated with the nozzles which are associated with the second power supply circuit, and a difference made by subtracting an average value A1 from an average value A4 and a difference made by subtracting an average value A2 from an average value A5 are both positive values or both negative values, the average value A1 being an average of values associated with the nozzles forming the first group, the average value A2 being an average of values associated with the nozzles forming the second group, the average value A4 being an average of values associated with the nozzles forming the fourth group, the average value A5 being an average of values associated with the nozzles forming the fifth group.

11. A printing apparatus, comprising:

a plurality of power supply circuits including at least a first power supply circuit and a second power supply circuit, the power supply circuits having mutually different output voltages;

a head including a plurality of nozzles, the nozzles forming a plurality of groups arranged in a first direction, each of the nozzles being associated with any one of the power supply circuits;

wherein the groups include a first group and a second group adjacent to each other in the first direction, the first group is formed by a plurality of nozzles associated with the first power supply circuit and a plurality of nozzles associated with the second power supply circuit, the second group is formed by a plurality of nozzles associated with the first power supply circuit and a plurality of nozzles associated with the second power supply circuit, a natural number value n is associated with the first power supply circuit, a natural number value m, which is different from the value n, is associated with the second power supply circuit, in the first group, the value n is associated with the nozzles which are associated with the first power supply circuit, and the value m is associated with the nozzles which are associated with the second power supply circuit, in the second group, the value n is associated with the nozzles which are associated with the first power supply circuit, and the value m is associated with the nozzles which are associated with the second power supply circuit, the groups further include a fourth group that is adjacent to the first group at a side in a second direction intersecting with the first direction and a fifth group that is adjacent to the second group at the side in the second direction, the power supply circuits further include a third power supply circuit, the third power supply circuit being associated with a natural number value k which is different from the value n and the value m, the fourth group is formed by a plurality of nozzles associated with the first power supply circuit and a plurality of nozzles associated with the second power supply circuit, the fifth group is formed by a plurality of nozzles associated with the second power supply circuit and a plurality of nozzles associated with the third power supply circuit, in the fourth group, the value n is associated with the nozzles which are associated with the first power supply circuit, and the value m is associated with the nozzles which are associated with the second power supply circuit, in the fifth group, the value m is associated with the nozzles which are associated with the second power supply circuit, and the value k is associated with the nozzles which are associated with the third power supply circuit, an average value A1 of values associated with the nozzles forming the first group is different from an average value A2 of values associated with the nozzles forming the second group, and a difference made by subtracting an average value A1 from an average value A4 and a difference made by subtracting an average value A2 from an average value A5 are both positive values or both negative values, the average value A1 being an average of values associated with the nozzles forming the first group, the average value A2 being an average of values associated with the nozzles forming the second group, the average value A4 being an average of values associated with the nozzles forming the fourth group, the average value A5 being an average of values associated with the nozzles forming the fifth group.

12. A printing apparatus, comprising:

a plurality of power supply circuits including at least a first power supply circuit and a second power supply circuit, the power supply circuits having mutually different output voltages;

a head including a plurality of nozzles, the nozzles forming a plurality of groups arranged in a first direction, each of the nozzles being associated with any one of the power supply circuits;

wherein the groups include a first group and a second group adjacent to each other in the first direction, the first group is formed by a plurality of nozzles associated with the first power supply circuit and a plurality of nozzles associated with the second power supply circuit, the second group is formed by a plurality of nozzles associated with the first power supply circuit and a plurality of nozzles associated with the second power supply circuit, a first dot array extending in the first direction is formed by discharging liquid droplets from all the nozzles forming the first group, a second dot array extending in the first direction is formed by discharging liquid droplets from all the nozzles forming the second group, in at least part of the first dot array, a plurality of first patterns, each of which includes a first dot and a second dot, are repeated in the first direction every 0.16 mm or less, the first dot being formed by a liquid droplet discharged from a nozzle associated with the first power supply circuit, the second dot being formed by a liquid droplet discharged from a nozzle associated with the second power supply circuit, and in at least part of the second dot array, a plurality of second patterns, each of which includes the first dot and the second dot, are repeated in the first direction every 0.16 mm or less.

13. The printing apparatus according to claim 12, wherein, in at least the part of the first dot array, the first patterns are formed in the first direction at intervals of equal to or less than 0.1 mm, and in at least the part of the second dot array, the second patterns are formed in the first direction at intervals of equal to or less than 0.1 mm.

14. The printing apparatus according to claim 12, further including a memory configured to store information indicating a correspondence between the nozzles and the groups and a correspondence between the nozzles and the power supply circuits, wherein printing is executed by driving the head based on the information.

15. The printing apparatus according to claim 12, wherein the number of the power supply circuits is equal to or less than the number of the groups.

16. A printing method using a printing apparatus that includes: a plurality of power supply circuits including at least a first power supply circuit and a second power supply circuit, the power supply circuits having mutually different output voltages; a head including a plurality of nozzles, the nozzles forming a plurality of groups arranged in a first direction, each of the nozzles being associated with any one of the power supply circuits, the method comprising:

discharging liquid on a print medium from the nozzles of the head; and moving the print medium relative to the nozzles, wherein the groups include a first group and a second group adjacent to each other in the first direction, the first group is formed by a plurality of nozzles associated with the first power supply circuit and a plurality of nozzles associated with the second power supply circuit, the second group is formed by a plurality of nozzles associated with the first power supply circuit and a plurality of nozzles associated with the second power supply circuit, a natural number value n is associated with the first power supply circuit, a natural number value m, which is different from the value n, is associated with the second power supply circuit, in the first group, the value n is associated with the nozzles which are associated with the first power supply circuit, and the value m is associated with the nozzles which are associated with the second power supply circuit, in the second group, the value n is associated with the nozzles which are associated with the first power supply circuit, and the value m is associated with the nozzles which are associated with the second power supply circuit, and an average value A1 of values associated with the nozzles forming the first group is different from an average value A2 of values associated with the nozzles forming the second group.

17. A printing method using a printing apparatus that includes: a plurality of power supply circuits including at least a first power supply circuit and a second power supply circuit, the power supply circuits having mutually different output voltages; a head including a plurality of nozzles, the nozzles forming a plurality of groups arranged in a first direction, each of the nozzles being associated with any one of the power supply circuits, the method comprising:

discharging liquid on a print medium from the nozzles of the head; and moving the print medium relative to the nozzles, wherein the groups include a first group and a second group adjacent to each other in the first direction, the first group is formed by a plurality of nozzles associated with the first power supply circuit and a plurality of nozzles associated with the second power supply circuit, the second group is formed by a plurality of nozzles associated with the first power supply circuit and a plurality of nozzles associated with the second power supply circuit, the groups further include a third group that is adjacent to the second group in the first direction at a side opposite to the first group, the third group is formed by a plurality of nozzles associated with the first power supply circuit and a plurality of nozzles associated with the second power supply circuit, a natural number value n is associated with the first power supply circuit, a natural number value m, which is different from the value n, is associated with the second power supply circuit, in the first group, the value n is associated with the nozzles which are associated with the first power supply circuit, and the value m is associated with the nozzles which are associated with the second power supply circuit, in the second group, the value n is associated with the nozzles which are associated with the first power supply circuit, and the value m is associated with the nozzles which are associated with the second power supply circuit, in the third group, the value n is associated with the nozzles which are associated with the first power supply circuit, and the value m is associated with the nozzles which are associated with the second power supply circuit, an average value A1 is an average of values associated with the nozzles forming the first group and an average value A2 is an average of values associated with the nozzles forming the second group, and the average value A2 is a value between the average value A1 and an average value A3 of values associated with the nozzles forming the third group.

18. A printing method using a printing apparatus that includes: a plurality of power supply circuits including at least a first power supply circuit and a second power supply circuit, the power supply circuits having mutually different output voltages; a head including a plurality of nozzles, the nozzles forming a plurality of groups arranged in a first direction, each of the nozzles being associated with any one of the power supply circuits, the method comprising:

discharging liquid on a print medium from the nozzles of the head; and moving the print medium relative to the nozzles, wherein the groups include a first group and a second group adjacent to each other in the first direction, the first group is formed by a plurality of nozzles associated with the first power supply circuit and a plurality of nozzles associated with the second power supply circuit, the second group is formed by a plurality of nozzles associated with the first power supply circuit and a plurality of nozzles associated with the second power supply circuit, the groups further include a fourth group that is adjacent to the first group at a side in a second direction intersecting with the first direction and a fifth group that is adjacent to the second group at the side in the second direction, the fourth group is formed by a plurality of nozzles associated with the first power supply circuit and a plurality of nozzles associated with the second power supply circuit, the fifth group is formed by a plurality of nozzles associated with the first power supply circuit and a plurality of nozzles associated with the second power supply circuit, a natural number value n is associated with the first power supply circuit, a natural number value m, which is different from the value n, is associated with the second power supply circuit, in the first group, the value n is associated with the nozzles which are associated with the first power supply circuit, and the value m is associated with the nozzles which are associated with the second power supply circuit, in the second group, the value n is associated with the nozzles which are associated with the first power supply circuit, and the value m is associated with the nozzles which are associated with the second power supply circuit, in the fourth group and the fifth group, the value n is associated with the nozzles which are associated with the first power supply circuit, and the value m is associated with the nozzles which are associated with the second power supply circuit, and a difference made by subtracting an average value A1 from an average value A4 and a difference made by subtracting an average value A2 from an average value A5 are both positive values or both negative values, the average value A1 being an average of values associated with the nozzles forming the first group, the average value A2 being an average of values associated with the nozzles forming the second group, the average value A4 being an average of values associated with the nozzles forming the fourth group, the average value A5 being an average of values associated with the nozzles forming the fifth group.

19. A printing method using a printing apparatus that includes: a plurality of power supply circuits including at least a first power supply circuit and a second power supply circuit, the power supply circuits having mutually different output voltages; a head including a plurality of nozzles, the nozzles forming a plurality of groups arranged in a first direction, each of the nozzles being associated with any one of the power supply circuits, the method comprising:

discharging liquid on a print medium from the nozzles of the head; and moving the print medium relative to the nozzles, wherein the groups include a first group and a second group adjacent to each other in the first direction, the first group is formed by a plurality of nozzles associated with the first power supply circuit and a plurality of nozzles associated with the second power supply circuit, the second group is formed by a plurality of nozzles associated with the first power supply circuit and a plurality of nozzles associated with the second power supply circuit, a natural number value n is associated with the first power supply circuit, a natural number value m, which is different from the value n, is associated with the second power supply circuit, in the first group, the value n is associated with the nozzles which are associated with the first power supply circuit, and the value m is associated with the nozzles which are associated with the second power supply circuit, in the second group, the value n is associated with the nozzles which are associated with the first power supply circuit, and the value m is associated with the nozzles which are associated with the second power supply circuit, the groups further include a fourth group that is adjacent to the first group at a side in a second direction intersecting with the first direction and a fifth group that is adjacent to the second group at the side in the second direction, the power supply circuits further include a third power supply circuit, the third power supply circuit being associated with a natural number value k which is different from the value n and the value m, the fourth group is formed by a plurality of nozzles associated with the first power supply circuit and a plurality of nozzles associated with the second power supply circuit, the fifth group is formed by a plurality of nozzles associated with the second power supply circuit and a plurality of nozzles associated with the third power supply circuit, in the fourth group, the value n is associated with the nozzles which are associated with the first power supply circuit, and the value m is associated with the nozzles which are associated with the second power supply circuit, in the fifth group, the value m is associated with the nozzles which are associated with the second power supply circuit, and the value k is associated with the nozzles which are associated with the third power supply circuit, and a difference made by subtracting an average value A1 from an average value A4 and a difference made by subtracting an average value A2 from an average value A5 are both positive values or both negative values, the average value A1 being an average of values associated with the nozzles forming the first group, the average value A2 being an average of values associated with the nozzles forming the second group, the average value A4 being an average of values associated with the nozzles forming the fourth group, the average value A5 being an average of values associated with the nozzles forming the fifth group.

20. A printing method using a printing apparatus that includes: a plurality of power supply circuits including at least a first power supply circuit and a second power supply circuit, the power supply circuits having mutually different output voltages; a head including a plurality of nozzles, the nozzles forming a plurality of groups arranged in a first direction, each of the nozzles being associated with any one of the power supply circuits, the method comprising:

discharging liquid on a print medium from the nozzles of the head; and moving the print medium relative to the nozzles, wherein the groups include a first group and a second group adjacent to each other in the first direction, the first group is formed by a plurality of nozzles associated with the first power supply circuit and a plurality of nozzles associated with the second power supply circuit, the second group is formed by a plurality of nozzles associated with the first power supply circuit and a plurality of nozzles associated with the second power supply circuit, a first dot array extending in the first direction is formed by discharging liquid droplets from all the nozzles forming the first group, a second dot array extending in the first direction is formed by discharging liquid droplets from all the nozzles forming the second group, in at least part of the first dot array, a plurality of first patterns, each of which includes a first dot and a second dot, are repeated in the first direction every 0.16 mm or less, the first dot being formed by a liquid droplet discharged from a nozzle associated with the first power supply circuit, the second dot being formed by a liquid droplet discharged from a nozzle associated with the second power supply circuit, and in at least part of the second dot array, a plurality of second patterns, each of which includes the first dot and the second dot, are repeated in the first direction every 0.16 mm or less.

* * * * *